United States Patent [19]

deButts, II

[11] Patent Number: 4,544,124

[45] Date of Patent: Oct. 1, 1985

[54] MOUNTING FOR CABOOSE REPLACEMENT SIGNAL TRANSMITTING UNIT

[75] Inventor: Harry A. deButts, II, Balleyhack, Upperville, Va.

[73] Assignee: Syscon Corporation, Washington, D.C.

[21] Appl. No.: 537,805

[22] Filed: Sep. 30, 1983

[51] Int. Cl.[4] ..... F16M 13/00

[52] U.S. Cl. ..... 248/552; 248/205.1

[58] Field of Search ..... 248/205.1, 231.5, 542, 248/552, 214, 231.6; 343/711, 713, 715; 213/1.3, 109, 152

[56] References Cited

U.S. PATENT DOCUMENTS

| | | | |
|---|---|---|---|
| 600,607 | 3/1898 | Benedict | 248/214 |
| 1,000,389 | 8/1911 | Ette | 248/231.6 |
| 1,095,242 | 5/1914 | Swift | 248/231 |
| 1,266,239 | 5/1918 | Ewart | 248/231 |
| 2,212,561 | 8/1940 | Frischeisen | 343/715 |
| 2,285,588 | 6/1942 | Kirkes | 343/711 |
| 3,076,936 | 2/1963 | Housman | 343/711 |
| 3,244,392 | 4/1966 | Sheets | 248/231 |
| 3,729,741 | 4/1973 | Otto | 343/713 |
| 4,118,003 | 10/1978 | Dillow | 343/715 |
| 4,206,849 | 6/1980 | Kaim | 213/109 |

*Primary Examiner*—Ramon S. Britts
*Assistant Examiner*—Ramon O. Ramirez
*Attorney, Agent, or Firm*—Brady, O'Boyle & Gates

[57] ABSTRACT

A bifurcated mounting bracket for a caboose replacement signal transmitting unit straddles the coupling knuckle of a rear train car and is secured to the knuckle by a lower end pivoted hasp which is padlocked to the bracket. Depending and upstanding teeth on the bracket and hasp, respectively, positively engage top and bottom surfaces of the coupling knuckle with minimized metal-to-metal contact. The signal transmitting unit is supported above the elevation of coupling crowns to avoid destruction. The mounting allows the coupling of another car in the train behind the car on which the signal transmitting unit is mounted without destruction of the unit or its mounting.

16 Claims, 3 Drawing Figures

MOUNTING FOR CABOOSE REPLACEMENT SIGNAL TRANSMITTING UNIT

BACKGROUND OF THE INVENTION

The elimination of the caboose from freight trains and its replacement by an electronic signal transmitting unit has given rise to problems concerning a safe and efficient mounting means for the transmitting unit. As is well known, this unit transmits signals to the locomotive indicating the presence or absence of brake pressure, when the last car of the train has stopped, and when the last car begins to move with the train.

Heretofore, it has been customary to provide a depending mounting pin on the signal transmitting box or unit, which pin engages supportingly in a vertical axis signal flag opening in the pivoted coupling knuckle of the rearmost car. Two problems are encountered with this mounting arrangement. First, in many instances, the signal flag opening is mashed or distorted so that it cannot accept the depending mounting pin of the signal transmitting unit. Second, the pin and signal flag opening are relatively small in cross section, preventing the slender pin from supporting the transmitting unit at a sufficient elevation to avoid destruction of the unit by the crown portion of an oncoming car coupler. Both of these problems are completely overcome by the present invention which provides a mounting for the transmitting unit which is much more stable while having the ability to support the transmitting unit above the elevation of coupling crowns. The mounting according to the present invention allows safe coupling of a car behind the car on which the signal transmitter is mounted without endangering the transmitter or its mounting and without interfering with the coupling operation.

A further feature of the invention resides in the minimizing of metal-to-metal contact between the mounting and coupling knuckle in order to reduce electrolysis. The efficient mounting is convenient to install and remove, sturdy and durable, and relatively inexpensive.

Other features and advantages of the invention will become apparent to those skilled in the art during the course of the following detailed description.

DETAILED DESCRIPTION

Figure 1:
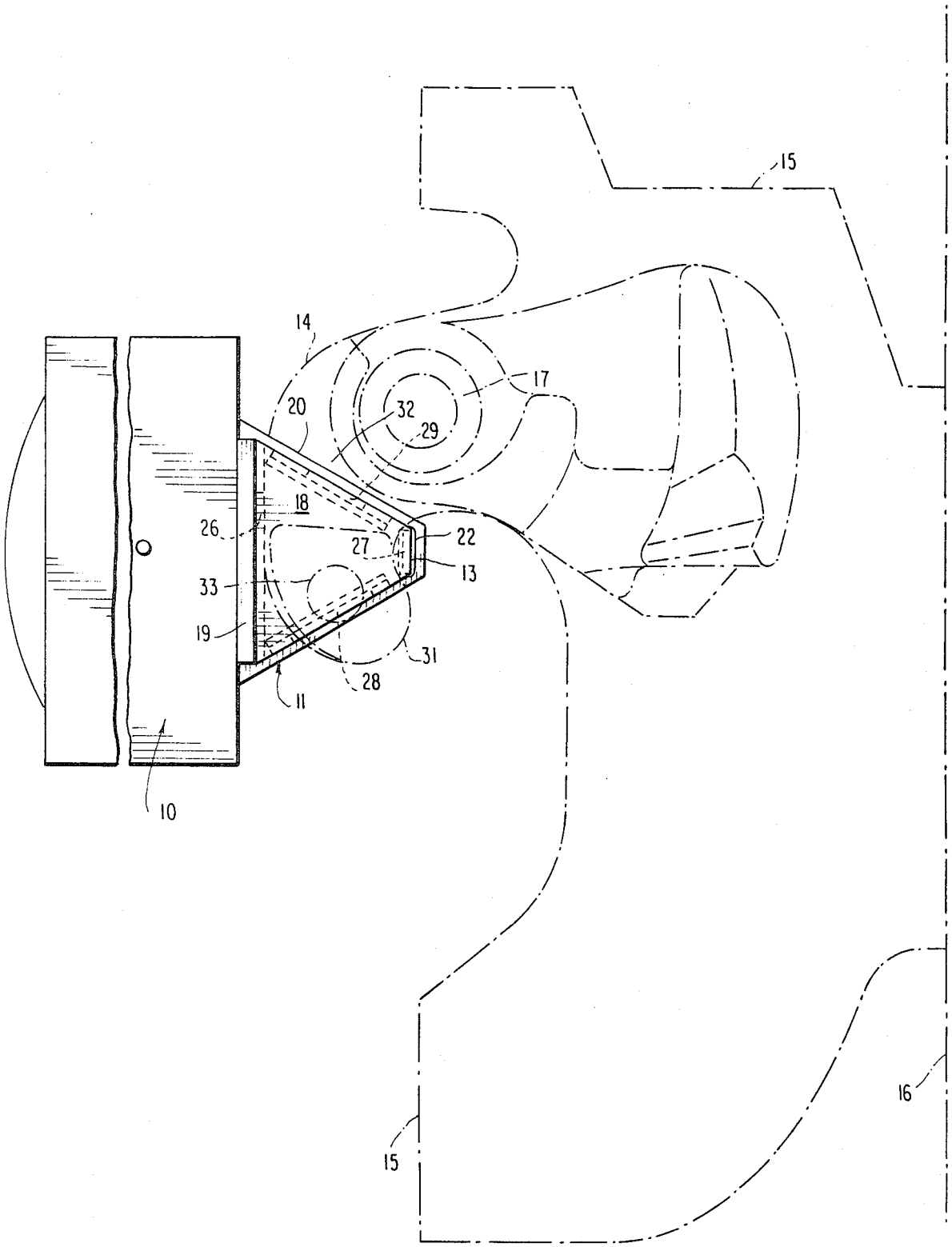
FIG. 1 is a plan view of a mounting for a caboose replacement signal transmitting unit with coacting car coupling components being shown in phantom lines.

Referring to the drawings in detail wherein like numerals designate like parts, a mounting for a caboose replacement signal transmitting unit 10 comprises a bifurcated mounting bracket 11 having two parallel leg portions 12 and 13 adapted to straddle the knuckle 14 of the coupling on the rearmost car of a train on which the electronic signal transmitting unit 10 requires mounting.

Figure 2:
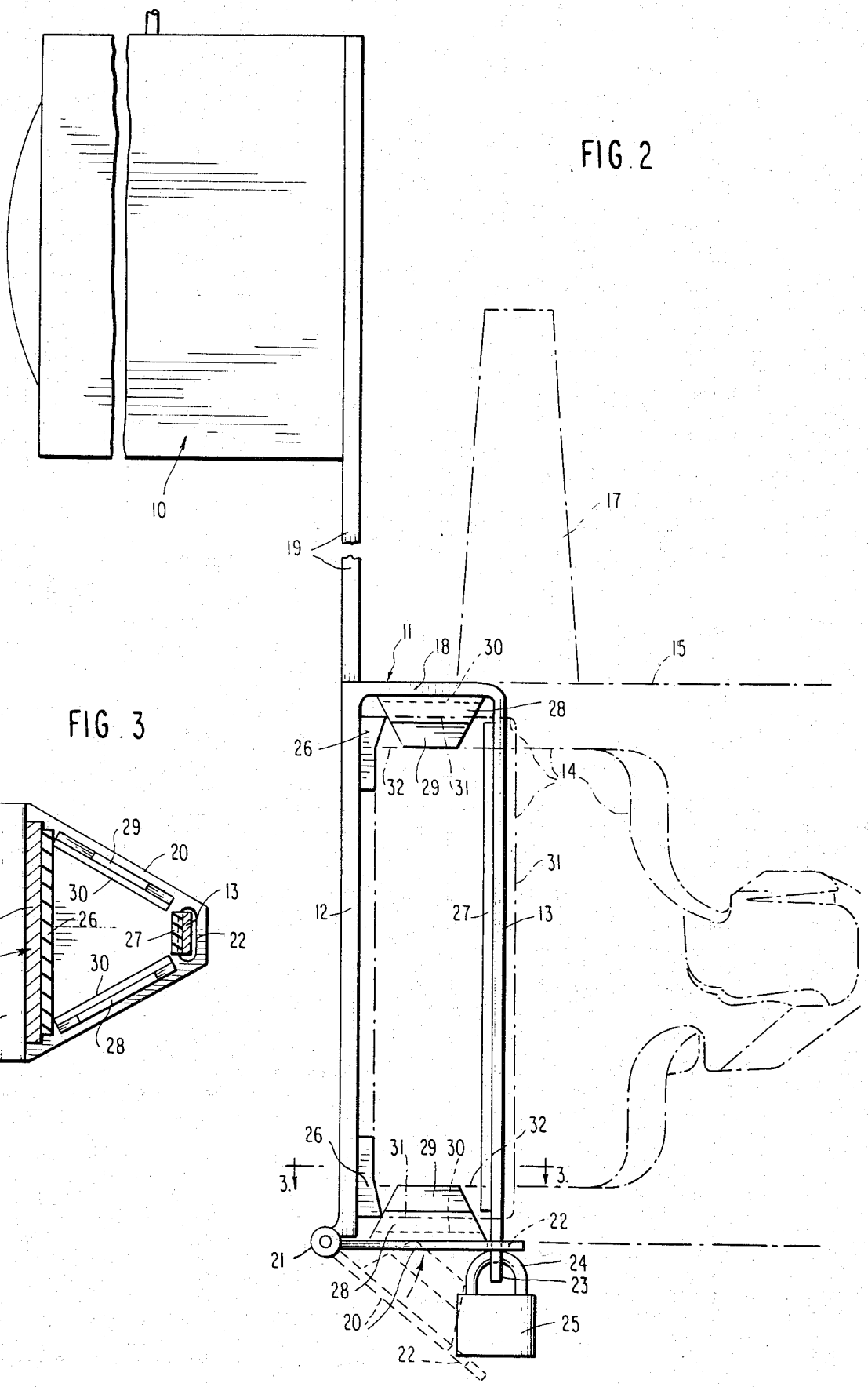
FIG. 2 is a side elevational view of the mounting.

Referring to FIGS. 1 and 2, the mounting structure takes advantage of the fact that the width of the coupling knuckle 14 in the front-to-back direction which is straddled by the leg portions 12 and 13 is a standard dimension in all makes or models of car couplings, which in other respects can vary in construction and design.

The coupling knuckle 14 is conventionally pivotally held on a coupling yoke 15 connected with the rear truck of the car on which the unit 10 is mounted, the rear end of such car being indicated at 16. The coupling yoke 15 includes a rising crown 17 which is a safety buffer to prevent an oncoming rail car coupling from riding up on top of the yoke 15 and possibly damaging the car to which the yoke is attached. As shown in FIG. 2, the transmitting unit 10 is supported above the elevation of the crown 17 to avoid destruction of the unit 10 by the crown of an oncoming car behind the car 16, in accordance with an important feature of this invention.

Figure 3:
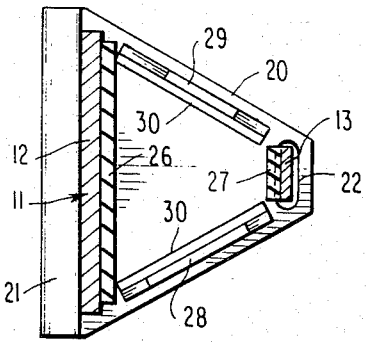
FIG. 3 is a horizontal section taken on line 3—3 of FIG. 2.

The rear leg portion 12 of mounting bracket 11 consists of a comparatively wide flat vertical plate, FIGS. 1 and 3, and the forward leg portion 13 consists of a relatively narrow and somewhat thinner plate. The two leg portions 12 and 13 are joined at their tops by a horizontal wall 18 which is trapezoidal in shape, FIG. 1. A vertical plate extension 19 forming a continuation of the leg portion 12 extends above the wall 11 and is supportingly connected with the electronic signal transmitter box or unit 10 to support the same securely and safely above the crown 17, for the reason already stated.

At its lower end, the bracket 11 carries a hasp plate 20 connected by a horizontal axis piano hinge 21 to the lower end of leg portion or plate 12 whereby the hasp plate 20 is swingable between a horizontal locked position and a release position shown in broken lines in FIG. 2. The hasp plate 20 is also trapezoidal and somewhat larger than the top wall 18, as indicated in FIG. 1.

The forward relatively narrow end of the hasp plate 20 contains an oblong opening 22 adapted to receive therethrough a lower end extension 23 of leg portion or plate 13, which extension is apertured to receive the shackle 24 of a padlock 25 below the hasp plate 20 to lock the mounting on the coupling knuckle 14. The padlock is preferably tethered to the bracket 11 through a suitable tether, not shown.

To eliminate electrolysis caused by direct metal-to-metal contact between the bracket 11 and knuckle 14, upper and lower hard rubber engaging strips 26 are provided on the forward face of plate 12 and directly engage the rear face of knuckle 14. A comparatively narrow hard rubber strip 27 is similarly provided on the rear face of vertical plate 13, or leg portion, and directly engages the curved frontal face of the knuckle 14. These rubber components also enable a relatively snug fit for the mounting on the coupling knuckle without appreciable movement, thus reducing wear.

Top and bottom opposite side forwardly converging metal stabilizing teeth 28 and 29 are provided on the bottom of the horizontal wall 18 and the top face of hasp plate 20. The teeth 28 and 29 which are vertically disposed are embodied in the vertical webs of short sections of angle bars whose horizontal webs 30 are fixed to the wall 18 and hinged hasp plate 20 as by welding.

Inasmuch as the coupling knuckle 14 becomes gradually thicker in its vertical dimension toward its terminal end 31, FIG. 1, commencing at a region approximately indicated by the numeral 32 where the knuckle has a constant thickness, the engaging teeth 28 and 29 are of different lengths, as clearly shown in FIG. 2. The longer teeth 29 have their tips engaging the top and bottom surfaces of knuckle 14 in the region 32 of constant and lesser thickness, while the relatively shorter teeth 28 have their tips engaging the top and bottom faces of the knuckle 14 at points of increasing thickness toward the thickest portion 31. The teeth 28 and 29 are also tapered in profile, FIG. 2, to minimize metal-to-metal contact with the knuckle, again for the purpose of avoiding electrolysis. The opposing top and bottom sets of teeth provide stability for the mounting in the vertical direction.

It should now be apparent that a simplified and secure mounting for the electronic signal transmitting unit 10 replacing the customary caboose is provided. The mounting is adaptable to all makes of car couplings because of the standard dimension front-to-back across the knuckle 14. By having the mounting bracket 11 straddle the knuckle 14 and locking it beneath the knuckle, all of the problems of the prior art occasioned by utilizing the signal flag aperture 33 of the knuckle 14 to support a spike-type mounting for the unit 10 are avoided and eliminated. The numerous advantages of the invention over the prior art should now be readily apparent to those skilled in the art without the necessity for further description.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A mounting for a caboose replacement signal transmitting unit comprising a bifurcated mounting bracket having spaced substantially parallel leg portions adapted to straddle the knuckle of a rail car coupling in a front-to-back plane and having a top wall interconnecting said leg portions above the top of the knuckle, releasable means on the mounting bracket and extending near and across the bottom of said knuckle to lock the bifurcated bracket to the knuckle, depending and upstanding stabilizing teeth on said top wall and said releasable means respectively adapted to engage top and bottom surfaces of the knuckle when the releasable means is in a substantially horizontal position locking the bracket to the knuckle, and an extension on the mounting bracket at its top of sufficient length to support a caboose replacement signal transmitting unit at an elevation above the top of a rail car coupling crown.

2. A mounting for a caboose replacement signal transmitting unit as defined in claim 1, and said releasable means comprising a pivoted hasp plate on the lower end of one straddling leg portion and adapted to be padlocked to the other leg portion of the mounting bracket across the bottom of said knuckle so that the bracket is arranged in completely surrounding relationship to the knuckle.

3. A mounting for a caboose replacement signal transmitting unit as defined in claim 2, and the hasp plate having an aperture near its free end adapted to receive therethrough a lower end extension of said other leg portion, and said lower end extension having a padlock shackle receiving aperture below the hasp plate.

4. A mounting for a caboose replacement signal transmitting unit as defined in claim 2, and said teeth being provided in spaced pairs on said top wall and hasp plate near opposite sides of the top wall and hasp plate, the teeth of the pairs near one side being longer than the teeth in the pairs near the opposite side, and the teeth on the top wall being downwardly tapered and the teeth on the hasp plate being upwardly tapered to minimize contact areas of the teeth with said knuckle.

5. A mounting for a caboose replacement signal transmitting unit as defined in claim 4, and said top wall and hasp plate being substantially trapezoidal and tapering forwardly with relation to the knuckle, said teeth in said pairs being forwardly convergent along edges of the top wall and hasp plate, and the rearwardmost of said straddling leg portions being substantially wider than the forward leg portion of the bifurcated mounting bracket.

6. A mounting for a caboose replacement signal transmitting unit as defined in claim 1 and said teeth being provided in spaced pairs on said top wall and releasable means near opposite sides of the top wall and releasable means.

7. A mounting for a caboose replacement signal transmitting unit as defined in claim 6 and said teeth in said pairs being forwardly convergent on said top wall and on said releasable means.

8. A mounting for a caboose replacement signal transmitting unit as defined in claim 1 and the rearwardmost of said parallel straddling leg portions being substantially wider than the forward leg portion of the bifurcated mounting bracket.

9. A device for mounting a caboose replacement signal transmitting unit on the knuckle of a railway car coupling comprising a bifurcated bracket having spaced substantially parallel legs adapted to straddle a coupling knuckle and a leg connecting top portion adapted to rest on a coupling knuckle supportingly, releasable locking means for the bifurcated bracket resisting upward displacement of the bracket when engaged with a coupling knuckle, depending and upstanding stabilizing teeth on said leg connecting top portion and said releasable locking means respectively adapted to engage top and bottom surfaces of the knuckle when the releasable locking means is in position to resist upward displacement of the bracket, a caboose replacement signal transmitting unit, and an extension support member rising from the top of the bracket and adapted to be connected with and to support a caboose replacement signal transmitting unit at a sufficient elevation above a coupling knuckle to avoid collision of the unit with the crown of another railway car coupling.

10. A device for mounting a caboose replacement signal transmitting unit as defined in claim 9, and said releasable locking means comprising a hinged hasp plate on the lower end of said bracket adapted to be locked in a substantially horizontal position across the bottom of a coupling knuckle while extending between said legs.

11. A device for mounting a caboose replacement signal transmitting unit as defined in claim 10, and the hasp plate being apertured to receive therethrough one leg of the bracket when the hasp plate is in its locked position, said one leg being apertured below the hasp plate, and a locking element engageable through the aperture of said one leg.

12. In a device for use with the knuckle component of a railway car coupling having a rear outer curved wall and a foward inner curved wall, the combination with the knuckle component of connector means having portions adapted to respectively engage the rear outer curved wall and forward inner curved wall of the knuckle, releasable locking means connected transversely between said portions to prevent removal of said connector means when engaged with the knuckle, a housing, and means connecting said housing to said connector means at an elevation above said portions which engage the walls of the knuckle.

13. The combination as defined in claim 12, in which said portions comprise a rear comparatively wide vertical leg portion for engagement with the rear outer curved wall of the knuckle, and a forward relatively narrow vertical leg portion for engagement with the inner curved wall of the knuckle.

14. The combination as defined in claim 13, and non-metallic elements on the opposing interior faces of said leg portions adapted to engage the forward inner curved wall and rear outer curved wall of said knuckle to avoid metal-to-metal contact of said connector means with said knuckle.

15. The combination as defined in claim 13, and said connector means including a wall portion interconnecting said rear leg portion and said forward leg portion on the end opposite said releasable locking means.

16. The combination as defined in claim 13, and said releasable locking means comprising a hasp plate hingedly connected on one end of said rear leg portion and adapted to be locked in a substantially horizontal position across a substantially horizontal surface of the knuckle while extending between said rear and forward leg portions.

* * * * *